US006215444B1

(12) United States Patent
Engeln

(10) Patent No.: US 6,215,444 B1
(45) Date of Patent: Apr. 10, 2001

(54) ARRAY ANTENNA

(75) Inventor: Christian Engeln, Aachen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/356,513

(22) Filed: Jul. 19, 1999

(30) Foreign Application Priority Data

Jul. 17, 1998 (DE) ..... 198 31 877

(51) Int. Cl.[7] ..... H01Q 1/38

(52) U.S. Cl. ..... 343/700 MS; 343/767; 343/771; 343/853

(58) Field of Search ..... 343/700 MS, 767, 343/770, 771, 846, 848, 850, 853; 333/24 C; H01Q 1/38

(56) References Cited

U.S. PATENT DOCUMENTS 4,364,050 * 12/1982 Lopez ..... 343/700 MS
4,843,400 * 6/1989 Tsao et al. ..... 343/700 MS
4,857,938 * 8/1989 Tsukamoto et al. ..... 343/700 MS
5,181,042 * 1/1993 Kaise et al. ..... 343/700 MS
5,512,906 4/1996 Speciale .
5,539,420 7/1996 Dusseux et al. .

FOREIGN PATENT DOCUMENTS 0 447 218 A2 9/1991 (EP) .

* cited by examiner

*Primary Examiner*—Tho Phan
(74) *Attorney, Agent, or Firm*—Venable; Robert Kinberg; Catherine M. Voorhees

(57) ABSTRACT

For an array antenna, comprising at least one array of multiple aerials, having several planar microwave resonators in strip transmission line technique, a structure is suggested for which the coupling to a feed line occurs via a window in the rear metal-coating that is completely covered by a resonator. The additional resonators in the array of multiple aerials are connected via connecting lines to the first-named resonator. The array antenna preferably comprises a larger number of arrays of multiple aerials.

6 Claims, 3 Drawing Sheets

ARRAY ANTENNA

CROSS-REFERENCE TO RELATED APPLICATIONS

Priority is claimed with respect to German Application No. 198 31 877.4 filed in Germany on Jul. 17, 1999, the disclosure of which is incorporated herein by reference.

BACKGROUND OF THE INVENTION

The invention relates to an array antenna with at least one array of multiple aerials with several planar microwave resonators in strip transmission line technique, which are connected to each other with micro strip transmission line segments.

Known antennas of this type contain features which are not adequate for many purposes, that is with respect to the antenna characteristic and increased undesirable radiation if T-junctions are present.

SUMMARY OF THE INVENTION

It is the object of the present invention to specify an array antenna of the aforementioned type, which has an improved antenna characteristic with reduced, undesirable radiation.

The above and other objects are accomplished according to the invention by the provision of an array antenna, comprising at least one array of multiple aerials with several planar microwave resonators in strip transmission line technique, which are connected to each other with micro strip transmission line segments, wherein a preferably rectangular window is provided underneath one of the microwave resonators for feeding an array of multiple aerials, which window is located in the rear metal-coating of the substrate, is covered completely by the resonator above and connects the resonator with a connecting line below the window.

Advantageous embodiments and modifications of the invention follow from the following detailed disclosure considered in conjunction with the accompanying drawings.

DETAILED DESCRIPTION OF THE INVENTION

An array of multiple aerials preferably comprises three resonators. However, it is advantageous if an array of multiple aerials comprises seven resonators. Particularly favorable qualities are exhibited by arrays with multiple aerials, W for which a first resonator R1 is located directly above the window KS and preferably extends past the window in longitudinal and lateral direction and the remaining resonators R2–R7 are distributed evenly, in particular in a circle around the centrally arranged first resonator R1 and are connected to the first resonator by separate connecting lines VL.

Arrangements with a mirror symmetry with respect to at least one, preferably two, crossed mirror planes that extend perpendicular to the substrate plane are advantageous. The several resonators preferably oscillate with the same phase and preferably have the same polarization.

By arranging the window K-5 below the metal-coated surface of one of the resonators R1 in the array of multiple aerials, the coupling to the connecting or feed line does not cause a direct radiation, e.g. as is the case when coupling into a microstrip transmission line. It is preferable if the power distribution occurs advantageously without complicated power network with discontinuity (particularly T-junctions). As a result, the power distribution is less sensitive to a higher substrate thickness. In addition, transmission line lengths are minimized, so that there are fewer line losses on the whole.

With respect to the substrate plane, the array antenna according to the invention has less pronounced directional dependencies as compared to a classic microstrip array of multiple aerials. There is less coupling of antenna elements than for the known designs, since the radiating edges of the individual resonator surfaces (patches) can be at greater distances.

Figure 1:
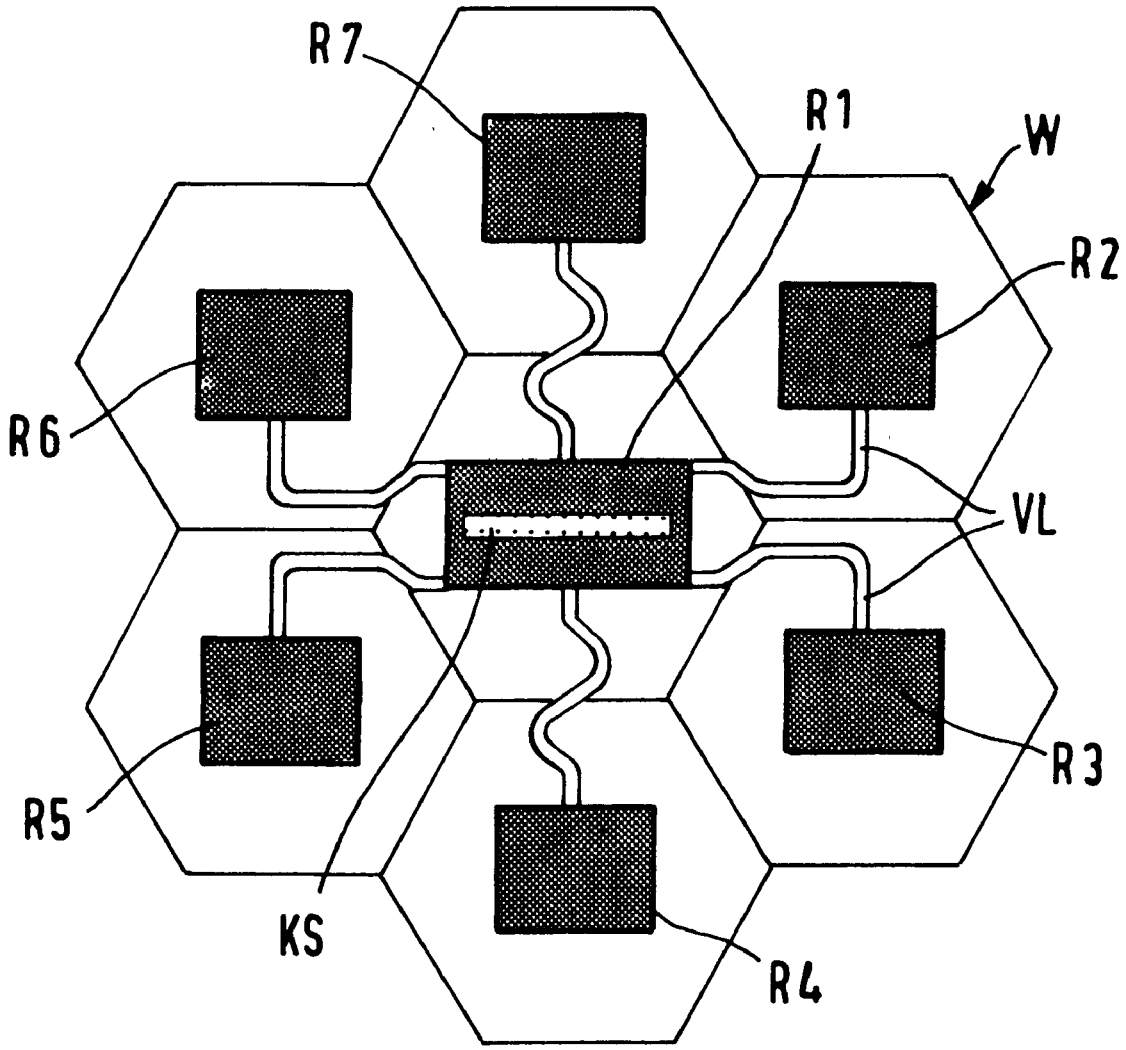
FIG. 1 is a schematic of an array antenna according to one embodiment of the invention.

FIG. 1 shows a particularly advantageous array of 7 radiator elements (resonators), for which the remaining resonators are arranged with uniform angular distribution around a centrally arranged first resonator R1, in a circle around this central resonator. In each case, two neighboring resonators have the same distances between the center points of the resonator surfaces. The surface distribution of the array antenna here can be divided into a uniform honeycomb pattern, sketched by auxiliary lines with breaks as in FIG. 1, with resonator surfaces that are respectively arranged in the center of the individual honeycomb cells. In the metal-coated surface of the first resonator R1, which is closed in the real case, the window KS underneath it is indicated in the back of the metal coating. The additional resonators R2 to R7, which surround the central resonator R1, are each directly connected to the central resonator via a microstrip transmission line VL. The lengths of the transmission lines VL are selected such that all resonators R1 to R7 oscillate with the same phase.

Figure 2:
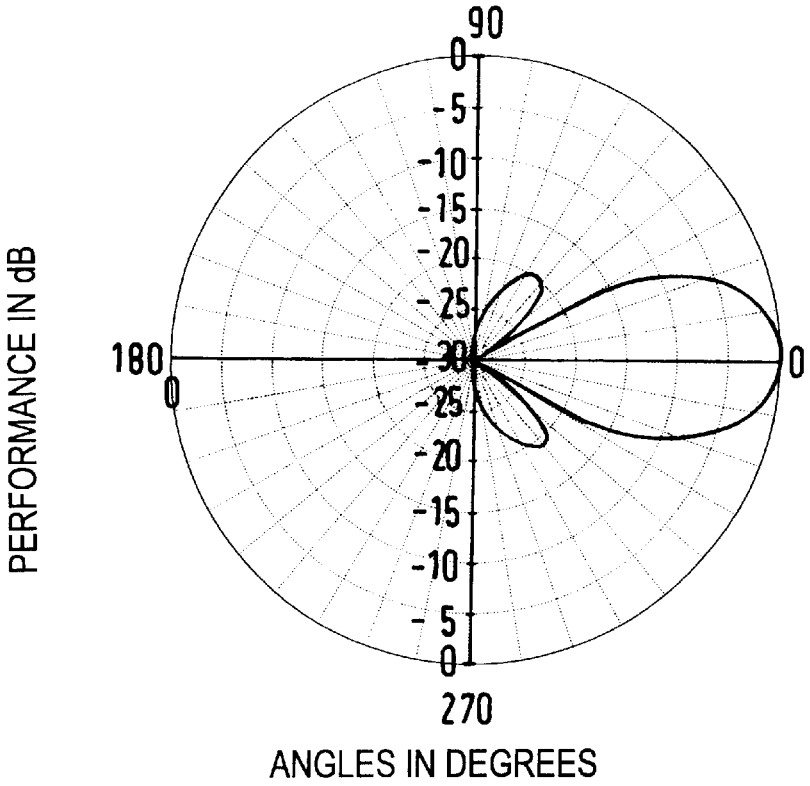
FIGS. 2 and 3 are diagrams showing antenna characteristics of an array of multiple aerials having the design as shown in FIG. 1.

FIG. 2 represents a section through the E-plane of the antenna and shows a typical characteristic of an array of multiple aerials, having the design as sketched in FIG. 1.

Figure 3:
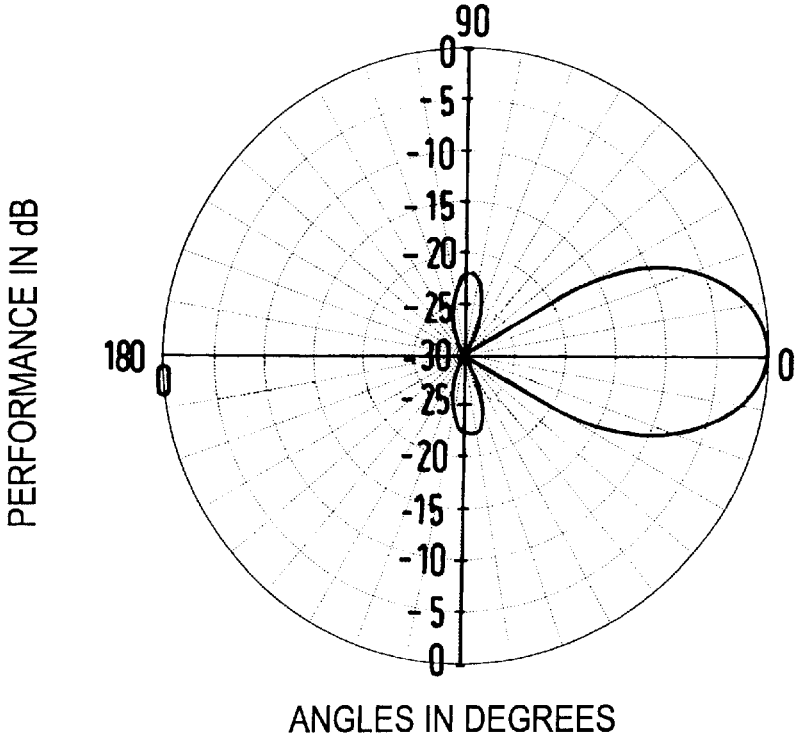

FIG. 3 shows a radiation characteristic for such an array of multiple aerials, in a plane that is tilted at a 30° angle to the E plane. The antenna patterns show a high concentration in the main lobe of the antenna pattern and a strong damping in the secondary lobe.

Figure 4:
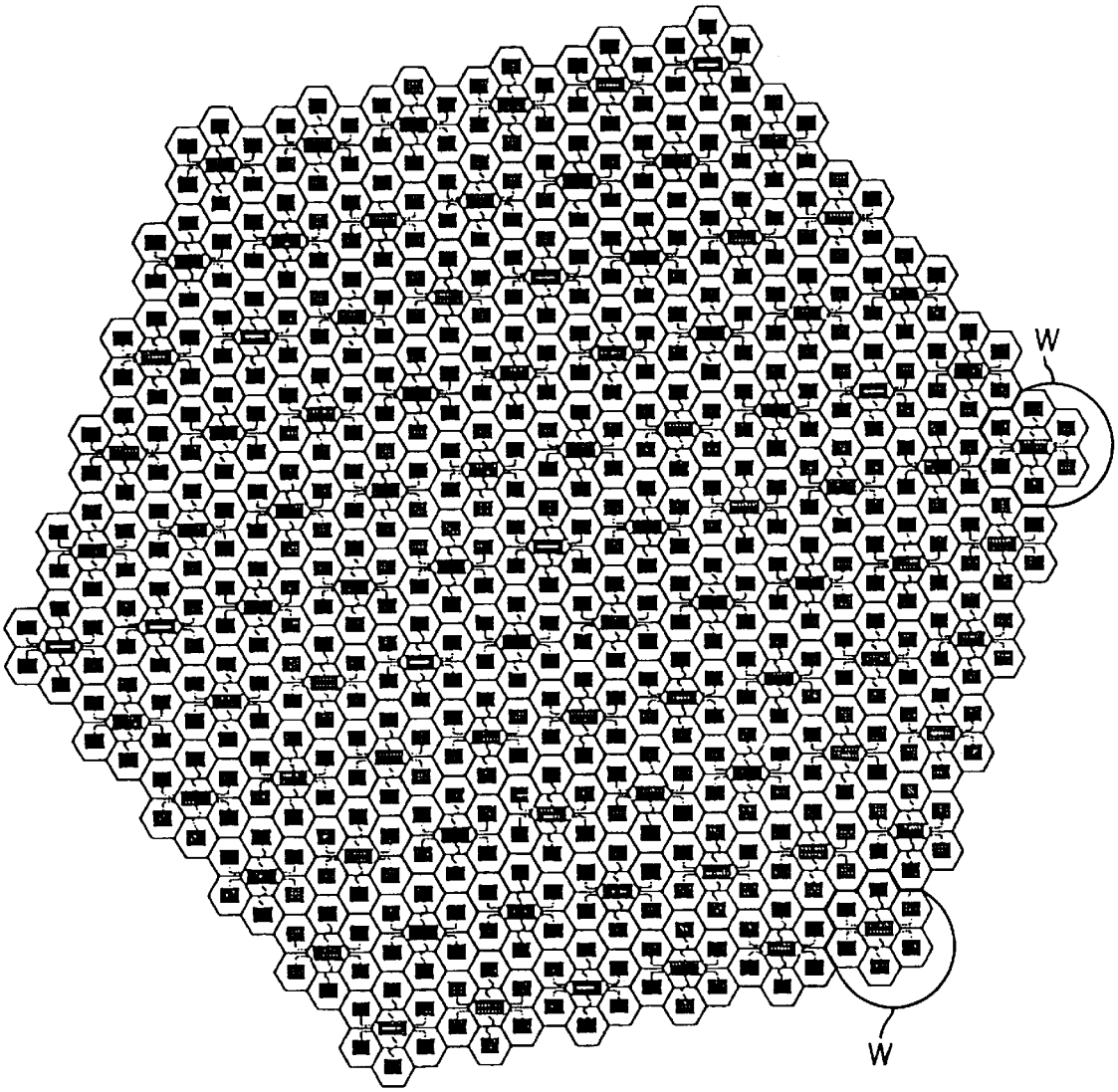
FIG. 4 is a schematic showing an array antenna composed of a plurality of different arrays with multiple aerials of the type shown in FIG. 1.

FIG. 4 shows an array antenna, 1 composed of a plurality of different arrays with multiple aerials, W of the type as sketched in FIG. 1, which are combined to form a regular arrangement. The array antenna 1 sketched for the concrete case consists, for example, of 91 arrays of multiple aerials with uniform design. The individual arrays of multiple aerials, W having respectively 7 radiator elements (resonators), in this case are coupled by way of a low-loss conductive network on the back of the antenna, via windows in the rear metal-coating, particularly a waveguide network with windows. Without any aperture occupancy, the antenna shows a slight half intensity width of less than 3° and a secondary lobe damping of more than 16 db.

The invention is not limited to the above-described exemplary embodiments, but can be changed in various ways within the framework of expert knowledge.

What is claimed is:

1. Array antenna, comprising at least one array of multiple aerials with several planar microwave resonators connected in micro strip transmission line technique, said microwave resonators being connected to each other with micro strip transmission line segments, wherein a rectangular window is provided underneath one of the microwave resonators for feeding an array of multiple aerials, said window being located in the rear metal-coating of a substrate forming the array and being covered completely by the one of the microwave resonators located above said window, said window further coupling the one resonator to a connecting line disposed below the window.

2. Array antenna according to claim 1, wherein the lengths of the micro strip transmission line segments are dimensioned such that all resonators in an array of multiple aerials oscillate with the same phase.

3. Array antenna according to claim 1, wherein in an array of multiple aerials the one resonator that is fed through the window is located in the center of the remaining microwave resonators belonging to the same array of multiple aerials, which surround said one resonator in a circle and are connected in the manner of a star with this one resonator by way of micro strip transmission line segments.

4. Planar array antenna according to claim 1, wherein several arrays of multiple aerials exist, which are respectively fed by a connecting line of a transmission line network on the back of the rear metal-coating.

5. Planar array antenna according to claim 1, wherein connecting or conducting networks of the microwave resonators are configured as micro strip transmission lines or micro strip transmission line networks on the back of the substrate.

6. Planar array antenna according to claim 1, wherein the transmission line segments or transmission line networks are configured on the back of the substrate as waveguides or waveguide networks.

* * * * *